United States Patent [19]

Miller et al.

[11] 4,444,487

[45] Apr. 24, 1984

[54] MULTIPLE-FLASH FUSER

[75] Inventors: Joel S. Miller, El Toro, Calif.; Dana G. Marsh, Rochester, N.Y.

[73] Assignee: Xerox Corporation, Stamford, Conn.

[21] Appl. No.: 54,381

[22] Filed: Jul. 2, 1979

[51] Int. Cl.[3] ..... G03G 15/20

[52] U.S. Cl. ..... 355/3 FU; 219/216

[58] Field of Search ..... 355/3 FU, 3 R; 219/216, 219/388

[56] References Cited

U.S. PATENT DOCUMENTS 3,445,626 5/1969 Michaels ..... 355/3 FU 3,529,129 9/1970 Rees ..... 355/3 FU 3,871,761 3/1975 Mabrouk ..... 355/11

*Primary Examiner*—Richard L. Moses

[57] ABSTRACT

Flash fusing apparatus for fixing toner images to copy substrates. The apparatus is characterized by the provision of a power supply and control for a flash lamp which produces multiple flashes which are coupled to a discrete portion of a copy substrate. Each individual flash is insufficient to effect fusing of the toner images, however, a predetermined number of flashes impinging on the same discrete portion of a copy substrate will effect coalescence of the toner after which cooling of the toner takes place resulting in fixing thereof to the substrate.

5 Claims, 2 Drawing Figures

MULTIPLE-FLASH FUSER

BACKGROUND

This invention relates to xerography and, more particularly, to an improved flash fusing method and apparatus for fixing toner images to copy substrates.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual toner image can be either fixed directly upon the photosensitive member or transferred from the member to another support, such as a sheet of plain paper, with subsequent affixing of the image thereto in one of various ways, as for example by heat.

In order to affix or fuse electrostatic toner material onto a support member by heat alone, it is necessary to provide sufficient heat to raise the temperature of the toner material to a point at which the individual particles of the toner material become tacky and coalesce. This action causes the toner to flow to some extent into the fibers or pores of support members or otherwise upon the surfaces thereof. Thereafter, as the toner material cools, solidification of the toner material occurs causing it to be firmly bonded to the support member. In both the xerographic as well as the electrographic recording arts, the use of thermal energy for fixing toner images onto a support member, e.g., paper, is old and well known.

One approach to thermal fixing of toner images is to expose the toner image to a flash lamp of the xenon type. First attempts at flash fusing used a single flash of the xenon lamp to expose the entire image or copy sheet. As will be appreciated, a high voltage source is required to effect fusing of a typical $8\frac{1}{2}\times 11$ document with a single flash. Typically, the flash is effected by triggering a capacitor previously charged for such purposes. Thus, the power supply and storage capacitor required are very expensive and quite large.

Further developments in the area of flash fusing, in view of the foregoing, led to a flash fusing system designed to expose or couple only half of the image (i.e., half of a copy page) to a single flash resulting in the employment of two flashes to effect fusing of the entire image. Obviously, the energy required for each flash in this type of system is only one half of the total energy required to fuse the entire image with a single flash, thereby resulting in a lower cost and smaller power supply.

Recent efforts to further reduce the size and cost of flash fusing systems has resulted in a totally new and different approach to flash fusing.

BRIEF SUMMARY OF THE INVENTION AND PRIOR ART

The new approach to flash fusing which forms the basis of the present invention takes advantage of the recently discovered fact that the total energy required to raise the temperature of the toner so that it becomes permanently adhered to the copy substrate, need not be irradiated to the toner all at one time, provided that the total radiation occurs within a predetermined period of time. In other words, it has been found that fusing can be effected when the toner is exposed repeatedly to a quantity of energy substantially less than that required for fusing, so long as, successive quantities preferably of equal magnitude are irradiated to the toner within the aforementioned predetermined time period, each successive quantity corresponding to one flashing of a xenon lamp.

It has been found that if the successive flashes are spaced closely enough then a staircase effect is exhibited, in that, a residual quantity of energy or some other physical parameter or combination of parameters is experienced by the toner such that with each successive flash the total quantity of the parameter or combination of parameters increases until, after a sufficient number of flashes have occurred, a fused image results.

By way of example, if it is assumed that temperature is the sole physical parameter contributing to the staircasing then each flash will partially elevate the toner temperature and each successive flash will occur at a time such that the toner doesn't have time to cool appreciably. Thus, an accumulative effect is attained by a plurality of pulses irradiated to the same area of the image or page containing the image, the result being a satisfactorily fused image.

In carrying out the invention, a copy sheet is moved past a xenon flash lamp pulsed at a frequency of, by way of example, 120 Hz. The movement of a copy sheet past the flash lamp is such that each incremental area of the image or sheet is exposed to a plurality of flashes, say on the order of twenty-five when fusing low density images (i.e., having an optical density of 0.2). Accordingly, the first of the flashes partially elevates the temperature of the incremental area and the second flash, which occurs before the toner temperature can return to ambient temperature, further elevates the temperature of the toner. By the time the last flash occurs the toner temperature has been elevated to a point at which coalescence occurs. Subsequent cooling of the toner results in a permanently fused image.

Heretofore, a multiple flash system (i.e., U.S. Pat. No. 3,871,761) has been employed for fusing toner images: such a device, however, does not couple multiple flashes to incremental areas of the image on the copy sheet carrying the image.

Figure 1:
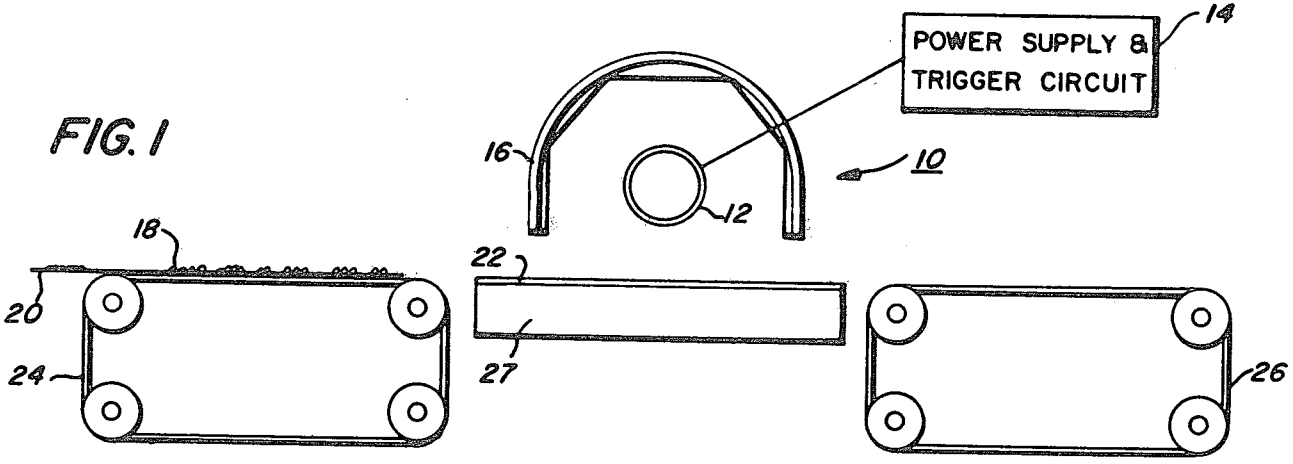
FIG. 1 is a schematic representation of a flash fuser representing the invention.

A flash fuser according to the present invention is illustrated in FIG. 1 and is generally designated by the reference character 10. The flash fuser comprises a 14 inch pulsed xenon arc lamp indicated by reference character 12 which is commercially available from the General Electric Company under the designation PXA 45. Alternatively an XOP-15 lamp may be employed which is also commercially available but from the Philips Company. Such lamps are specifically designed to flash on the half cycle of an alternating current source, therefore, when operated on a standard frequency of 60 Hz the number of flashes per second equals 120.

A power supply and flash lamp triggering circuit generally indicated in block form by reference character 14 is commercially available from the Chadwick-Helmuth Company under the designation PX 1500.

A reflector 16 is provided for reflecting radiant energy emanating from the lamp onto a toner image or images 18 carried by a support member 20 which, by way of example, may comprise plain paper. Other suitable substrates may comprise cellulose-acetate and paper-like compositions. It will be appreciated that energy from the lamp may impinge on the reflector many times before striking the toner images. In order to enhance the reflective properties of the reflector, the internal surface thereof is rendered highly specular. While the reflector may comprise various shapes, a preferred reflector is a multi-facetted (i.e., 5 facets) construction. As shown, its reflecting surface approximates the reflective pattern of a parabolic reflector, therefore, it is effective to collimate the radiant energy across the open end or aperture of the reflector. In one working embodiment of the fuser, the reflector opening is one inch in the direction of movement of the copy sheet and is at least greater (i.e., 15 inch) in length than the transverse dimension of the copy sheet, for example, 11 to 14 inches where the paper is transported past the flash lamp along its width. Where the open end of the reflector is one inch across, it has a maximum height of 1.0 inch and the lamp has an outside diameter of 0.4 inches or less. The lamp envelope is supported at a height of 0.20 inch above the copy substrate.

A low mass baseplate 22 supports the support member 20 as it is moved past the lamp 12. Inlet and outlet conveyor belts 24 and 26 serve to transport the support member through the fuser 10 with the toner images to be fused being opposite the lamp and with the nonimage side, in the case of simplex imaging, contacting the baseplate 22. The baseplate measures 0.020 inch thick by 15 inches in length by 1.0 inch in width. The top surface of the baseplate which is preferably fabricated from aluminum is anodized in order to provide a black surface. A $\frac{3}{8}$ inch thick piece of insulation 27 is provided at the underside of the baseplate in order to minimize thermal losses.

Figure 2:
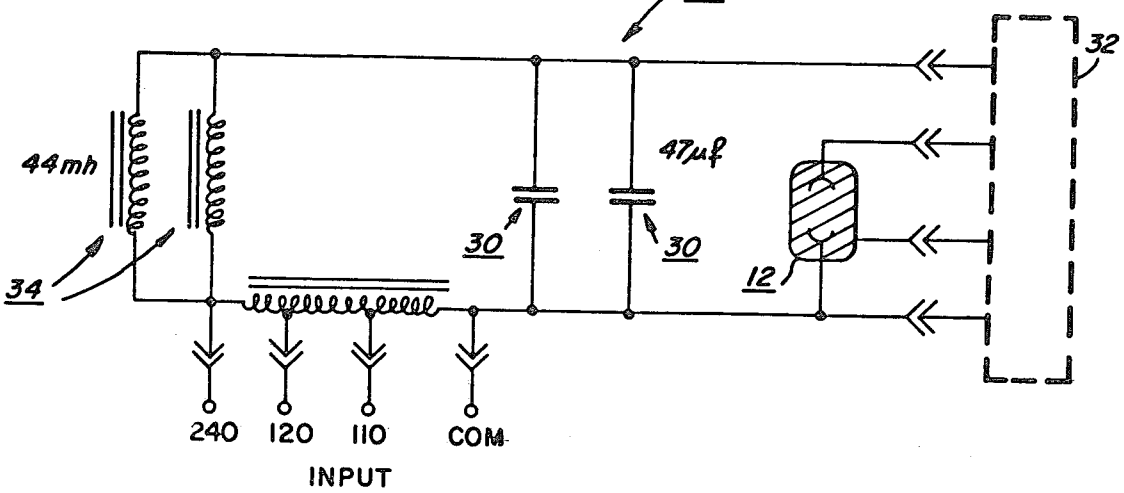
FIG. 2 is an electrical schematic illustrating a control circuit for the fuser of FIG. 1.

While the aforementioned Chadwick-Helmuth circuit was employed for triggering the flash lamp, it is believed that the present invention may be more readily understood by referring to a simplified electrical circuit diagram such as that illustrated in FIG. 2 and generally referenced by the numeral 28. The circuit 28 comprises two capacitors 30 connected in parallel with the flash lamp 12 via a cyclically actuated switch 32 and a pair of chokes 34 connected in series with the capacitors 30. Each of the capacitors is rated at 47 $\mu$f and each choke at 44 mh. The circuit is powered by 240 V A.C. provided by an autotransformer plugged into a conventional 110 VAC supply. The switch represents a 15 KV trigger circuit and 60 Hz half cycle timing circuit.

With 2250 watts input to the lamp 12 and operated in the configuration of FIG. 1 and with the copy substrates moved at a rate of 5 inches per second (30 copies per minute, CPM), satisfactory fix was obtained at a flashing rate of 120 flashes per second. This corresponds to twenty four flashes per discrete toner area.

Other reflector configurations have been utilized. For example, a five facet reflector wherein the reflecting surface approximated the reflective patterns of an elliptical reflector. All other operating parameters were the same as those of the parabolic approximation.

A semicircular configuration (1 inch high×2 inch aperture) was also employed wherein the reflector was fabricated from pyrex glass which was coated with a specular surface of aluminum on its inside surface. A $\frac{3}{8}$ inch thick insulating material such as Fiberfrax (a registered trademark of the Carborundum Co.) was provided on the outside surface of the reflector. The baseplate comprised 0.02 inch×15 inch×2 inch aluminum lighting sheet with an Alzak specular finish on its top surface which was grit blasted. The underside of the baseplate was provided with a $\frac{3}{8}$ inch Fiberfrax insulating layer. Excellent fix was obtained at a copy substrate speed of 8.3 inches per second (50 CPM), corresponding to thirty flashes per toner area. The lamp power, position relative to the copy substrate and outside lamp diameter were all the same as in the previous examples.

The semicircular reflector was also used in an embodiment where the lamp power was 750 watts and the lamp outside diameter was 0.4 inch or less, with the lamp envelope positioned at 0.20 inch above the copy substrate. Excellent fix was obtained at a copy speed of 3.4 inches per second (20 CPM) when the duty cycle of the lamp was set to 60% resulting in 24 flashes per toner area.

An additional reflector configuration was utilized which contained nine facets yielding a parabolic approximation. Both the baseplate and the reflector were provided with a specular surface and each was thermally insulated by a $\frac{3}{8}$ inch thick piece of Fiberfrax insulation. At a lamp power of 2250 watts, excellent fix was obtained at copy speeds up to six inches per second (35 CPM) at forth flashes per toner area.

Typical toners satisfactorily fused by the disclosed fusers are as follows:

Spar-II toner as disclosed in U.S. Pat. No. 3,590,000;

Spar-II toner plus an additive such as Zinc Stearate or submicroscopic pyrozenic silicone made at 1100° C.;

Flak, which is a copolymer of styrene and n butyl methacrylate in a preferred ratio of 65–35 by weight which copolymer is mixed with furnace carbon black in lieu of the heretofore conventional channel carbon black;

A copolymer of 58% styrene and 42% n-butyl methacrylate;

A terpolymer of styrene, methyl methacrylate and ethylhexyl methacrylate;

A magnetic toner comprising 65% (wt.) of Mapico Black ($Fe_3O_4$), 35% (wt.) Emerez 1552 a polyamide resin (commercially available from Emery Industries, Inc.) and 0.5% (wt. based on polymer) donor acid-based Silanox which is similar to the silicone material mentioned above;

Magnetic toner comprising 65% (wt.) Mapico Black ($Fe_3O_4$), 35% (wt.) Hexomethylsebacate, (0.5% (wt.) Silanox and 3.5% (wt.) ($CaCO_3$ based on polymer);

Magnetic toner comprising 65% (wt.) Mapico Black ($Fe_3O_4$), (35% (wt.) Spar-II and (0.4% (wt.) Silanox based on polymer) and;

Magnetic toner comprising 65% (wt.) carbonyl Fe, (35% (wt.) Flak and (0.4% (wt.) Silanox based on polymer).

What is claimed is:

1. Apparatus for fixing toner images by coupling radiant energy to the toner; said apparatus comprising:

a flash lamp;

means for flashing said flash lamp a plurality of times, each flash being insufficient to cause coalescing of the toner forming the images;

means for effecting relative movement between said flash lamp and a substrate carrying said toner images, said movement being at a rate permitting irradiation of a discrete portion of said copy substrate a plurality of times sufficient to effect coalescing of toner forming said images;

means for supporting said substrate during said movement; and a reflector for focusing the irradiation from said flash lamp onto said substrate and images, said flash lamp being disposed intermediate said reflector and said supporting means, said reflector comprising five facets with a reflecting surface approximating the reflective pattern of an elliptical reflector.

2. Apparatus according to claim 1 wherein heat insulating material is provided under said supporting means and behind said reflector to minimize the heat losses therefrom.

3. Apparatus according to claim 2 wherein said means for energizing said flash lamp comprises a pair of capacitors connected in parallel with said flash lamp via a cyclically actuated switch and a pair of chokes connected in series with said capacitors and forming a part of an autotransformer.

4. Apparatus according to claim 2 wherein the open end of said reflector is one inch across and has a maximum height of 1.0 inch, and wherein said lamp has an outside diameter of 0.4 inches or less and the lamp envelope is supported 0.2 inches above the copy substrate.

5. Apparatus according to claim 2 wherein said reflector has a one-inch height and an aperture of two inches and said flash lamp has an outside diameter of 0.4 inches and is supported 0.2 inch above the copy substrate.

* * * * *